United States Patent [19]

Melvin et al.

[11] Patent Number: 4,880,241

[45] Date of Patent: Nov. 14, 1989

[54] GOLF BALL

[75] Inventors: Terrence Melvin, Somers, Conn.; R. Dennis Nesbitt, Westfield, Mass.

[73] Assignee: Spalding & Evenflo Companies, Inc., Tampa, Fla.

[21] Appl. No.: 184,910

[22] Filed: Apr. 22, 1988

[51] Int. Cl.[4] ..... A63B 37/12

[52] U.S. Cl. ..... 273/232; 273/235 A

[58] Field of Search ..... 273/232, 235 R, 235 A, 273/235 B, 213

[56] References Cited

U.S. PATENT DOCUMENTS

| | | | |
|---|---|---|---|
| D. 243,866 | 3/1977 | Shaw et al. | D34/5 QQ |
| D. 247,685 | 4/1978 | Haines et al. | D34/5 QQ |
| 878,254 | 2/1908 | Taylor | 273/232 |
| 1,286,834 | 12/1918 | Taylor | 273/232 |
| 2,106,704 | 2/1938 | Davis | 273/62 |
| 2,728,576 | 12/1955 | Martin et al. | 273/232 |
| 4,141,559 | 2/1979 | Melvin et al. | 273/220 |
| 4,560,168 | 12/1985 | Aoyama | 273/232 |
| 4,653,758 | 3/1987 | Solheim | 273/232 |
| 4,681,323 | 7/1987 | Alaki et al. | 273/232 |

FOREIGN PATENT DOCUMENTS

| | | | |
|---|---|---|---|
| 377354 | 7/1932 | United Kingdom | 273/232 |
| 1353871 | 5/1974 | United Kingdom | 273/232 |
| 2148132A | 5/1974 | United Kingdom | 273/232 |
| 2148132B | 9/1987 | United Kingdom | 273/232 |

*Primary Examiner*—George J. Marlo

*Attorney, Agent, or Firm*—Donald R. Bahr; John E. Benoit

[57] ABSTRACT

A dimpled configuration for a golf ball wherein, in the first embodiment, the dimples are arranged in a geometrical lattice configuration so as to form a perfect icosahedral pattern which inlcudes twenty indentical triangles with a predetermined number of dimples lying along the lines forming the lattice. These dimples are a first diameter, while the dimples within the lattices are of a second diameter greater than the first diameter. In the second embodiment, the five adjacent triangles having common polar vertices are retained on either side of the equatorial line of the ball. Five smaller triangles on either side of the equator include vertices common with each adjacent set of the five triangles, with the legs opposite such vertices being substantially parallel with but terminating short of the equatorial line of the ball. The legs parallel with the equator extend about the ball so as to form five trapezoids which have common sides with the alternate with the five small triangles. In the preferred embodiment, the edge radius of the dimples is greater than the standard edge radius.

8 Claims, 3 Drawing Sheets

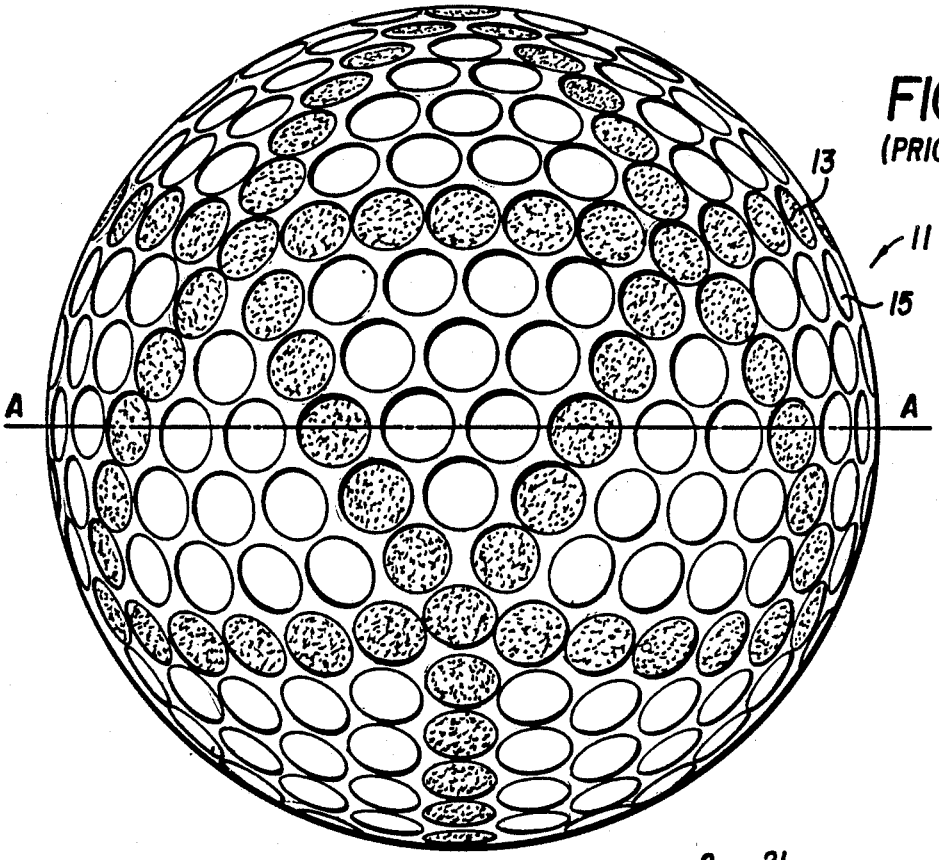
FIG. 1
(PRIOR ART)
FIG. 2
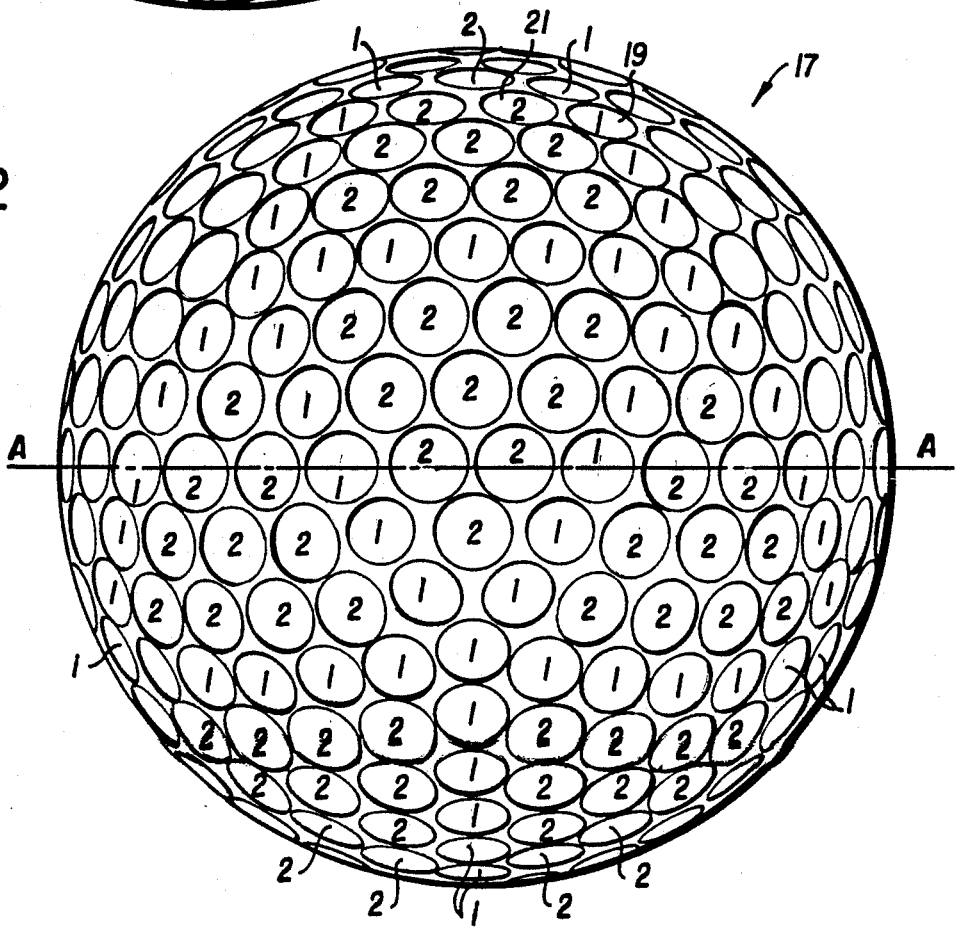

GOLF BALL

This invention relates generally to golf balls and more particularly to a specific arrangement of the dimples on a golf ball.

It is generally known that for any given selected number of dimples on a golf ball, it is desirable that the area of the surface of the golf ball covered by the dimples be a maximum in order to provide the best flight characteristics for a golf ball. In British Patent Provisional Specification Serial No. 377,354, filed May 22, 1931, in the name of John Vernon Pugh, there is disclosed the fact that by the use of an icosahedral lattice for defining dimple patterns on a golf ball it is possible to make a geometrically symmetrical ball. This icosahedral lattice is developed by the known division of a sphere or spherical surface into like areas determined by an inscribed regular polyhedron such as an icosahedron. The Pugh specification specifically details the means of plotting the icosahedron on the surface of the golf ball and, accordingly, will not be dealt with in detail here. Thus, with a selected number and size of the dimples placed in this icosahedral pattern, the area of the surface of the ball covered by the dimples is fixed.

Additionally, a problem arises with the Pugh icosahedron golf ball in that there is no equatorial line on the ball which does not pass through some of the dimples on the ball. Since golf balls are molded and manufactured by using two hemispherical half molds normally having straight edges, the ball, as it comes from the mold, has a flash line about the equatorial line created by the two hemispheres of the mold. Such molding results in a clear flash line. Even if the ball could be molded with dimples on the flash line, the ball could not be properly cleaned and finished in any efficient manner since the flash could not be cleaned from the bottom of the dimple without individual treatment of each dimple.

The Pugh ball is geometrically symmetrical. Any changes in dimple location which affect the aerodynamic symmetry under U.S.G.A. standards will render the ball illegal for sanctioned play. Many proposals have been made and balls have been constructed with a modification of the Pugh icosahedral pattern so as to provide an equatorial line which is free of dimples. Again, it is emphasized that any such modification must be aerodynamically symmetrical.

U.S.G.A. rules of golf require that the ball shall be designed and manufactured to perform in general as if it were aerodynamically symmetrical. A golf ball which is dimpled in some manner may be geometrically symmetrical and not aerodynamically symmetrical. A perfect example of a golf ball which is both geometrically symmetrical and aerodynamically symmetrical is a smooth sphere. As is well known, this ball is not capable of providing the necessary performance required in present day golf. To conform, all balls must be aerodynamically symmetrical. This symmetry is determined by actual tests of the ball as it is being struck by a machine which belongs to the U.S.G.A.

An object of the present invention is to improve the flight characteristics of an icosahedral lattice, dimpled golf ball and modifications of such an icosahedral lattice.

A further object of this invention is to design a ball having improved flight characteristics which presents a modified icosahedral lattice while providing a substantially dimple-free equatorial line.

A further object of this invention is to provide a golf ball having a dimple pattern based on an icosadhedral lattice or a modification thereof and having two sets of dimples, the diameter of one set of dimples being different from the diameter of the other set of dimples.

A further object of this invention is to provide a golf ball having two sets of dimples, with the diameter of one set of dimples being different from the diameter of the other set of dimples, and having opposed in-line dimples spaced on either side of an equatorial line created by the modification of an icosahedral pattern.

A still further object of this invention is to provide a golf ball having two sets of dimples with the dimple edge having a radius of curvature substantially greater than standard.

These and other objects of the invention will become obvious from the following description and accompanying drawings.

BRIEF SUMMARY OF THE INVENTION

The present invention provides a dimpled configuration for a golf ball having either a perfect icosahedron or a modified icosahedral lattice configuration created by the dimples. The dimples which lie along the lines of the lattice formed by the icosahedral triangles or modifications thereof are of a preselected diameter. Substantially all of the dimples lying within such lattice work are of a diameter greater than the diameter of the dimples lying along the lines formed by the lattice. In one modification, the icosahedral pattern is modified so as to provide two rows of in-line dimples on opposite sides of a preselected equatorial line about the ball so as to create a dimple-free flash line. In a preferred embodiment, the edges of the dimples have a radius of curvature substantially greater than the standard radius of curvature.

BRIEF DESCRIPTION OF THE DRAWINGS

FIG. 1 is a plan view of a perfect icosahedral pattern ball, with the shaded dimples indicating the pattern;

FIG. 2 is a plan view illustration of the ball of FIG. 1 with the dimple size modified in accordance with the present invention;

DETAILED DESCRIPTION OF THE PREFERRED EMBODIMENTS

Referring to FIG. 1, there is disclosed a golf ball having a perfect icosahedral pattern which, in the example shown, has 362 dimples, all dimples being of the same size—that is, having the same diameter and depth. Dimples 13, shown in the dark shading, indicate the icosahedral pattern which is formed by these dimples. Dimples 15, which are unshaded, indicate the dimples within the icosahedral pattern. As clearly shown, equator A-A passes through a plurality of the dimples in the icosahedral pattern. With a perfect icosahedral pattern of 362 dimples, it is not possible to avoid the passing of the equator through the dimples.

FIG. 2 discloses the same perfect icosahedral pattern as shown in FIG. 1. In order to increase the area on the surface of the ball which is covered by the dimples, however, dimple size has been varied. The dimples marked with the numeral "1" are the dimples which lie on the lattice work as indicated by the shaded dimples of FIG. 1. These dimples all have a predetermined diameter; in the particular case shown, the diameter was chosen to be 0.150 inches.

In order to increase the area which is covered by the dimples, which is an object of the present invention, the dimples designated by the numeral 2 are of a larger diameter than dimples 1. In the present example, these dimples are 0.160 inches in diameter. As can be seen, increasing the diameter of the dimples within the lattice results in these dimples being much closer together and in some cases actually touching. Obviously, this will increase the area of the ball covered by the dimples and, thus, improve the flight characteristics of the ball—particularly as to distance. Nevertheless, the equatorial line A-A still passes through these dimples.

Figure 3:
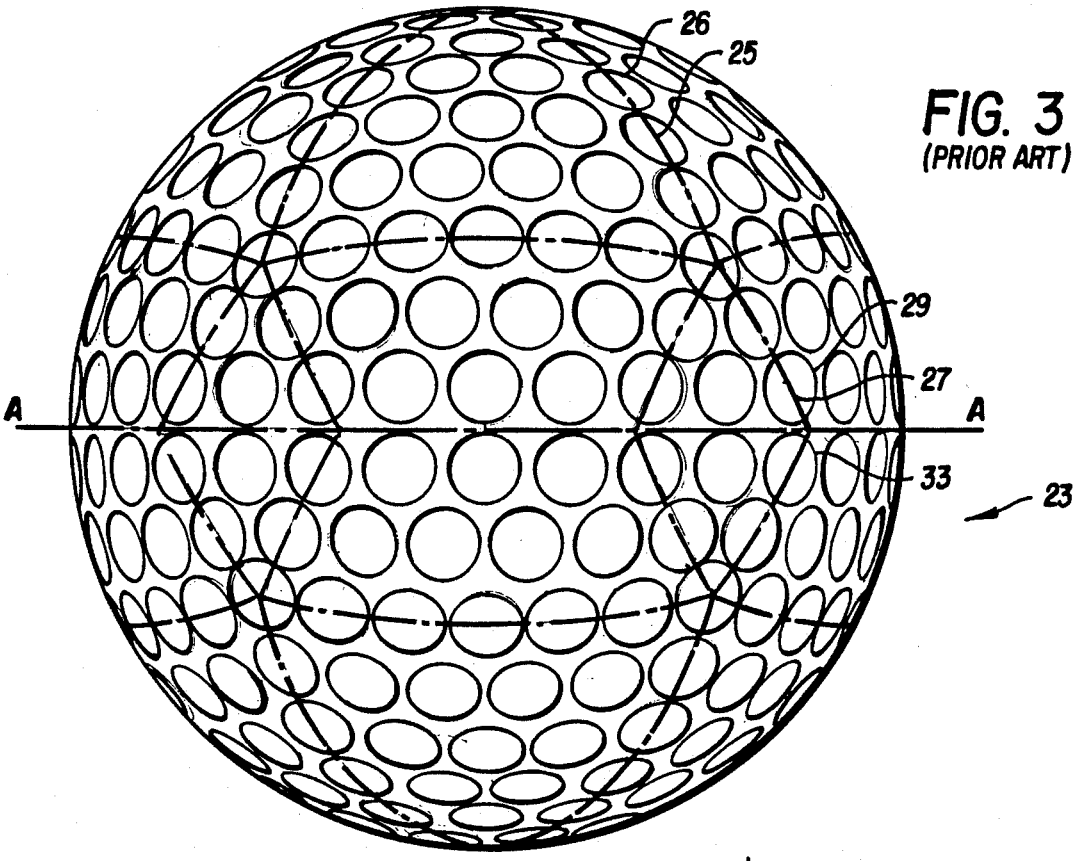
FIG. 3 (PRIOR ART)
FIG. 3 is an illustration of a modification of the icosahedral pattern of FIG. 1, providing a dimple-free area along the equator.

In order to create an equatorial line which does not pass through the dimples, the icosahedral lattice of FIG. 1 has been modified to a geometrical construction which is shown in FIG. 3. A true icosahedral dimple pattern will work only with a certain number of dimples within the practical size constraints for dimples on a golf ball in relation to the sphere surface area. The most practical numbers are 252, 362, and 492. With the 362-dimple arrangement one still has the problem of the equatorial line passing through the dimples and, thus, producing a flash line which is unacceptable in mass production of golf balls, as discussed above. In order to avoid this problem and to establish an equatorial line which is dimple-free, 32 dimples were removed in order to produce a space for the flash line. This modification is shown in FIG. 3.

The ball of FIG. 3 still maintains five triangles 25 of the original icosahedral triangle, with these five triangles terminating in a vertices at the pole of the ball. Likewise, the same five triangles are maintained on the opposite side of the ball, having a common vertice at the opposite pole. Five small triangles 27 are formed about the equator on either side thereof, with these triangles having common vertices with the adjacent associated triangles having the polar vertices. The sides opposite the common vertices are substantially parallel to the equatorial line A. This same configuration exists on the opposite side of the equator so that a space exists between rows of dimples 29 and 33. Dimples 29 are in a substantially aligned fashion so that they maintain a constant distance from the equator. Dimples 33 are also in this aligned configuration. By extending these in-line dimples, trapezoids 31 are formed adjacent to and between the smaller triangles on each side of the equator. In the configuration shown in FIG. 3, all dimples are of the same size.

In order to adapt the present invention to the modified icosahedral arrangement of FIG. 3, in the manner that the configuration of FIG. 2 is adapted to the perfect icosahedral triangle arrangement of FIG. 1, all of the dimples which lie along the lattice formed by the geometrical figures of FIG. 3 are of a predetermined diameter D1. This predetermined diameter D1 is indicated as numeral 1 in FIG. 4. In order to increase the area of the surface of the ball covered by the dimples, substantially all the dimples within the lattice work, indicated as numeral 2, are of an increased diameter D2 greater than the diameter D2 of dimples 1. As can be seen, this causes the dimples to be very close and even touch in some instances. It is to be noted that the dimple-free equatorial line A is still maintained, and the in-line dimples adjacent the equator are still maintained, with some of the in-line dimples being larger than others.

Figure 4:
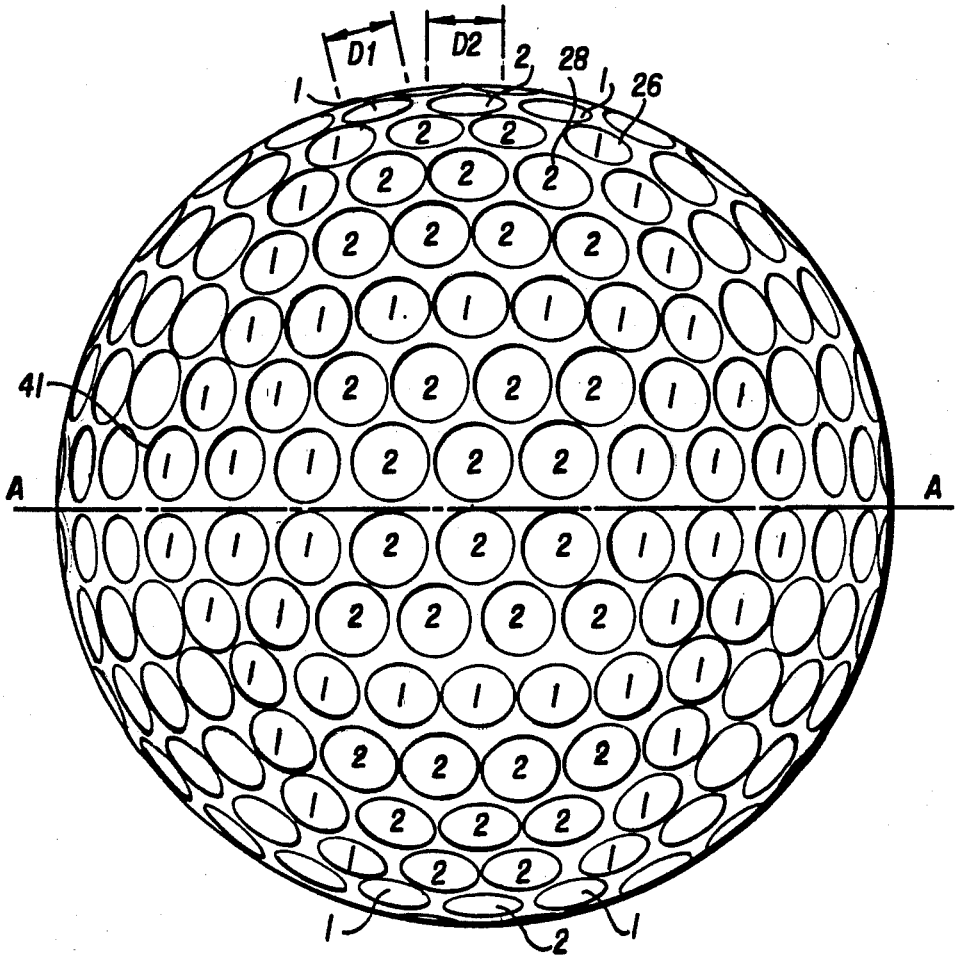
FIG. 4 is a plan view of the ball of FIG. 3, having dimple size modifications in accordance with the present invention.

In the particular showing of FIG. 4, the only dimples within the lattice work which are not increased in size are dimples 41, which are the single dimples within each of the small triangles 27 (FIG. 3) on either side of the equator. It is to be understood, however, that these dimples may also be increased to the size of dimple "2"without departing from the present invention.

Figure 5:
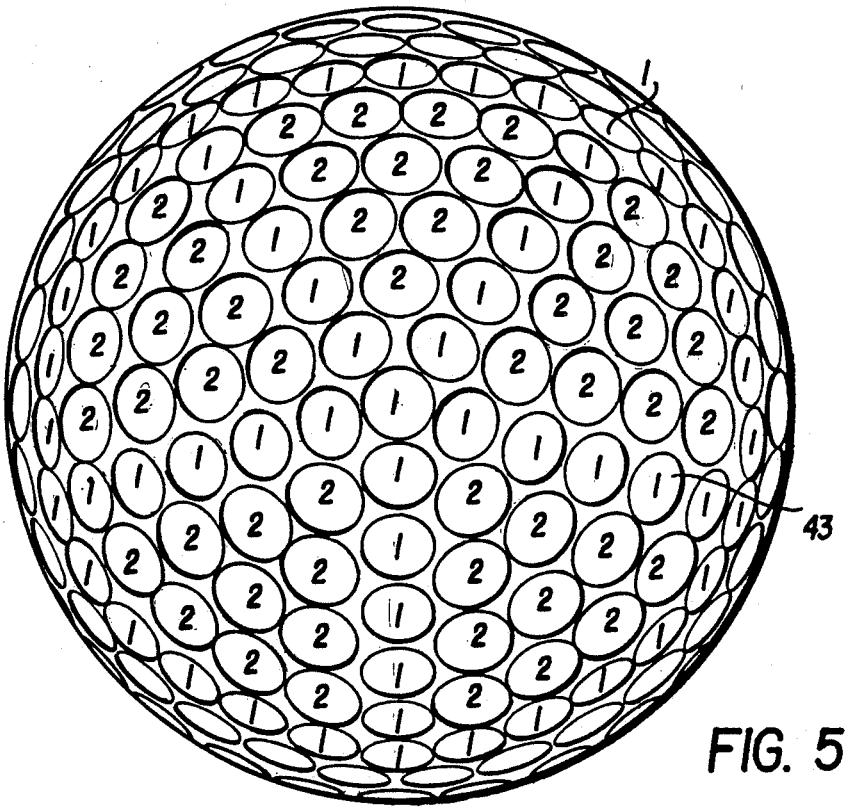
FIG. 5 is a top polar view of the ball of FIG. 4.

FIG. 5 is a top view, or polar view, showing the dimple arrangement as set forth in FIG. 4. In this illustration, dimple 43 is at the pole and the remaining dimples extend to create the pattern as shown in FIG. 4—again with the smaller dimple diameter being indicated with the numeral 1 and the larger dimple diameter being indicated with the numeral 2.

Figure 6:
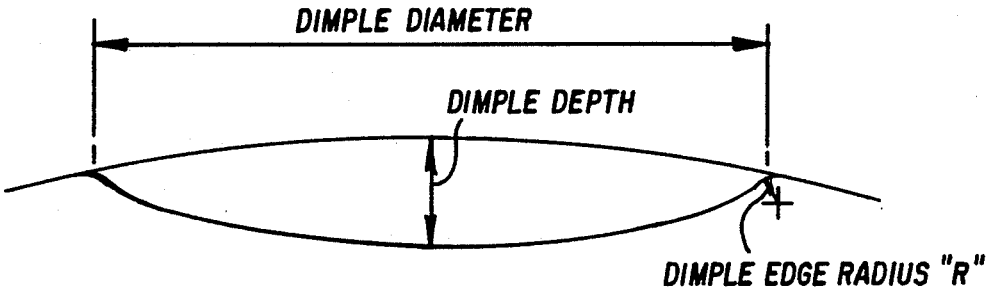
FIG. 6 is a schematic illustration of the dimple diameter, depth, and edge radius of the golf ball of the present invention.

FIG. 6 is a schematic illustration of a cross-section of a dimple and shows dimple diameter, depth, and an edge radius R. This will be referred to in specific examples as the description proceeds.

The ball of FIG. 1 includes a perfect icosahedral pattern. In the particular ball shown, there are 362 dimples, all the same size. In the configuration shown in FIG. 2, there still are 362 dimples. The dimples along the lines formed by the lattice indicated by numeral "1," however, are of a diameter of substantially 0.150 inches while the dimples indicated by numeral "2" are substantially 0.160 inches in diameter. Thus, there are 172 dimples having a smaller diameter and 190 dimples having a larger diameter.

In FIG. 3, the modified icosahedral triangle includes 332 dimples, with all dimples being of the same size—namely, 0.155 inches.

The ball of FIG. 4 maintains the same geometrical configuration as does the ball of FIG. 3. Dimples designated by numeral "1" lie along the lattice formed by the geometrical patterns and are of a diameter of substantially 0.155 inches while interior dimples designated by numeral "2" are of a diameter of substantially 0.168 inches. In this particular configuration, dimples 41 within the small triangles adjacent the equator are of the smaller diameter of substantially 0.155 inches.

Referring to FIG. 6, the depth of the dimples of the ball illustrated in FIG. 4 and 5 all have a common depth of substantially from 0.0111 to 0.0118 inches and an edge radius of substantially between 0.080 to 0.110 inches. This refers to the finished ball as opposed to the initial cut radius. It is to be noted that this edge radius is substantially greater than the standard radius which varies between 0.050 and 0.070.

Testing of the ball of FIGS. 4 and 5 under standard U.S.G.A. conditions, as compared to the ball of FIG. 3 under the same conditions, developed the following results:

BALL - FIGS. 4 AND 5

| Media Time (Minutes) | Number of Dimples | Dimple Diameter (Inches) | Dimple Depth (Inches) | Dimple Edge Radius (Inches) | Driving Machine Data: Trajectory (Grid Points) | Flite Time (Seconds) | Carry Distance (Yards) | Total Distance (Yards) |
|---|---|---|---|---|---|---|---|---|
| 30 | 170 | 0.168 | 0.0118 | 0.065 | 15.5 | 6.36 | 250.7 | 274.4 |
| 60 | 162 | 0.154 | 0.0117 | 0.057 | | | | |
| | 170 | 0.169 | 0.0117 | 0.075 | 15.8 | 6.38 | 252.4 | 275.7 |
| | 162 | 0.155 | 0.0116 | 0.067 | | | | |
| 180 | 170 | 0.168 | 0.0116 | 0.094 | 16.3 | 6.54 | 256.7 | 276.4 |
| | 162 | 0.154 | 0.0114 | 0.083 | | | | |
| 300 | 170 | 0.167 | 0.0113 | 0.098 | 17.2 | 6.72 | 259.6 | 278.3 |
| | 162 | 0.154 | 0.0114 | 0.091 | | | | |
| 420 | 170 | 0.164 | 0.0111 | 0.107 | 17.6 | 6.79 | 259.5 | 276.3 |
| | 162 | 0.152 | 0.0111 | 0.095 | | | | |

BALL - FIG. 3

| Media Time (Minutes) | Number of Dimples | Dimple Diameter (Inches) | Dimple Depth (Inches) | Dimple Edge Radius (Inches) | Driving Machine Data: Trajectory (Grid Points) | Flite Time (Seconds) | Carry Distance (Yards) | Total Distance (Yards) |
|---|---|---|---|---|---|---|---|---|
| 30 | 332 | 0.157 | 0.0117 | 0.060 | 16.4 | 6.26 | 247.4 | 265.5 |
| 60 | 332 | 0.155 | 0.0119 | 0.062 | 16.5 | 6.28 | 248.2 | 264.8 |
| 180 | 332 | 0.155 | 0.0115 | 0.083 | 16.6 | 6.44 | 252.0 | 267.9 |
| 300 | 332 | 0.155 | 0.0112 | 0.090 | 17.4 | 6.58 | 253.8 | 266.5 |
| 420 | 332 | 0.154 | 0.0111 | 0.100 | 17.9 | 6.66 | 254.1 | 267.1 |

Note:
Total number of dimples and dimple coordinates same for both ball types. Balls in both examples were tested together in the same test.

Referring to the ball of FIGS. 4 and 5, the present invention shows that the two different dimple sizes are superior to the prior art of the ball of FIG. 3 by up to nine yards in total distance when media tumbled for a standard time of 30 minutes.

Media tumble is a normal process for preparing golf balls for finishing prior to painting or clear coating the surface of the golf ball. This process is performed by vibrating and tumbling approximately 240 dozen molded golf balls in a wet abrasive medium. The purpose is to smooth the flash line area, remove any rough surfaces, foreign material such as dirt and mold release, and to provide a radius edge to the dimples. The normal media time is 30 minutes and this results in a dimple edge radius of about 0.060″. Increasing the dimple edge radius results in a shallower dimple, higher ball trajectory, increased flight time of the ball, longer carry, and longer total distance. In the present invention the optimum dimple edge radius is about 0.080″ to 0.110″. This dimple edge radius may be formed either by extended media tumbling times on the molded ball or by incorporating these radii in the dimpled golf ball cavities that are used in forming the molded ball by either injection or compression molding the outer dimpled surface.

Distance tests were performed using a True Temper Mechanical Golf Driving Machine at West Palm Beach, Fla. The golf club was a standard U.S.G.A. driver at a club head speed of 160′ per second. Launch angle at the start of the test was 8.0° and at the finish of the test was 8.0°. Spin rate using a standard control ball at the start of the test was 2607 r.p.m. and 2557 r.p.m. at the end of the test. Temperature was 62° F., relative humidity 86%, wind 0–2 miles per hour head. Turf conditions were dry.

Trajectory is measured in grid points similar to the U.S.G.A. set up where one grid point is approximately equal to 0.4 degrees. Flight time is started at club impact of ball and stopped when ball hits ground. Carry distance is distance from tee to where the ball makes impact on the ground. Total distance is carry distance plus roll distance.

As can be seen, in referring to a media time of 30 minutes, the increase in the size of the dimples within the lattice work so as to reduce the non-dimpled area of the surface of the ball increased the total carry of the ball by over three yards and the total distance by nearly nine yards. When the radius of the dimple edge is substantially increased on both balls, the ball of the present invention had a total distance increase of nearly twelve yards. In both instances the ball of the present invention provides a very significant increase in total distance.

It is to be understood that the above description and drawings are illustrative, only, since the configuration and relative sizes of the dimples could be varied without departing from the invention, which is to be limited only by the scope of the following claims.

We claim:

1. A golf ball having two poles and an equator and having a preselected number of diplomas arranged in a geometrical lattice configuration, said configuration comprising a first plurality of dimples having a predetermined diameter, D1, lying along the lattice lines of said configuration, said diameter, D1, being between 0.150 and 0.160 inch;

a second plurality of dimples lying within said geometrical lattice, substantially all of said second plurality of dimples having a predetermined diameter, D2 between 0.160 and 0.170 inch; and the edge radius, R, of said first and second plurality of dimples being between 0.090 and 0.110 inch.

2. The golf ball of claim 1 wherein said first plurality of dimples have a diameter of substantially 0.154 and said second plurality of dimples have a diameter of substantially 0.167.

3. The golf ball of claim 1 wherein the edge radius of said first plurality of dimples is substantially 0.090 and the edge diameter of said second plurality of dimples is substantially 0.100.

4. The golf ball of claim 1 wherein the preselected number of dimples is 332, comprising 162 of said first plurality of dimples and 170 of said second plurality of dimples.

5. A golf ball having two poles and an equator and having a preselected number of dimples arranged in a geometrical lattice configuration based upon a modified icosahedral lattice, said lattice comprising a first plurality of adjacent triangles on either side of the equator of the ball, with the vertices of each of said adjacent triangles being located at each pole of said ball;

a second plurality of triangles smaller than said first plurality of triangles equally spaced on either side of the equator of the ball, said second plurality of triangles having vertices common with each adjacent set of said first plurality of triangles, with the legs extending from said vertices terminating at the equator of the ball so as to form trapezoids having common sides with and alternating with said second plurality of triangles;

a first plurality of dimples along the lines forming the lattice except at the equator, said dimples along said lattice lines having a diameter between 0.150 inch and 0.160 inch;

a second plurality of dimples within said lattice, substantially all of said dimples within said lattice having a diameter between 0.160 inch and 0.170 inch; and the edge radius of all of said dimples being between 0.090 inch and 0.110 inch.

6. The golf ball of claim 5 wherein said first plurality of dimples have a diameter of substantially 0.154 and said second plurality of dimples have a diameter of substantially 0.167.

7. The golf ball of claim 5 wherein the edge radius of said first plurality of dimples is substantially 0.090 and the edge diameter of said second plurality of dimples is substantially 0.100.

8. The golf ball of claim 5 wherein the preselected number of dimples is 332, comprising 162 of said first plurality of dimples and 170 of said second plurality of dimples.

* * * * *